US011132957B2

(12) United States Patent
Chen et al.

(10) Patent No.: US 11,132,957 B2
(45) Date of Patent: Sep. 28, 2021

(54) METHOD AND APPARATUS FOR PERFORMING DISPLAY CONTROL OF AN ELECTRONIC DEVICE WITH AID OF DYNAMIC REFRESH-RATE ADJUSTMENT

(71) Applicant: MEDIATEK INC., Hsin-Chu (TW)

(72) Inventors: Po-Ting Chen, Hsin-Chu (TW); Tai-Hua Tseng, Hsin-Chu (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 16/559,563

(22) Filed: Sep. 3, 2019

(65) Prior Publication Data

US 2020/0111427 A1 Apr. 9, 2020

Related U.S. Application Data

(60) Provisional application No. 62/740,466, filed on Oct. 3, 2018.

(51) Int. Cl.
*G09G 5/00* (2006.01)
*G09G 3/34* (2006.01)

(52) U.S. Cl.
CPC ..... *G09G 3/34* (2013.01); *G09G 2320/103* (2013.01); *G09G 2360/18* (2013.01)

(58) Field of Classification Search
CPC ..... G09G 3/34; G09G 2320/103; G09G 2360/18; G09G 5/00; G09G 3/36; G09G 3/2096; G09G 2340/0435; G09G 3/20; G06F 3/0416; H04M 1/72522; H04M 1/72597
See application file for complete search history.

(56) References Cited

U.S. PATENT DOCUMENTS

2010/0118114 A1 5/2010 Hosseini
2013/0249964 A1* 9/2013 Sampsell ..... G09G 3/3688 345/690

FOREIGN PATENT DOCUMENTS

CN 106357896 A 1/2017
CN 107368424 A 11/2017
TW 201428733 A 7/2014

* cited by examiner

*Primary Examiner* — Adam R. Giesy
(74) *Attorney, Agent, or Firm* — Winston Hsu

(57) ABSTRACT

A method and apparatus for performing display control of an electronic device are provided. The method may include: outputting an initial image, for displaying the initial image; checking whether a subsequent image is generated; in response to the subsequent image being not generated, checking whether a consecutively-skipped-image count is greater than or equal to a consecutively-skipped-image count threshold; and in response to the consecutively-skipped-image count being not greater than or equal to the consecutively-skipped-image count threshold, skipping a latest image, for preventing displaying the latest image, wherein the subsequent image is expected to be a next image of the latest image.

17 Claims, 6 Drawing Sheets

METHOD AND APPARATUS FOR PERFORMING DISPLAY CONTROL OF AN ELECTRONIC DEVICE WITH AID OF DYNAMIC REFRESH-RATE ADJUSTMENT

CROSS REFERENCE TO RELATED APPLICATIONS

This application claims the benefit of U.S. Provisional Application No. 62/740,466, which was filed on Oct. 3, 2018, and is included herein by reference.

BACKGROUND

The present invention is related to image display, and more particularly, to a method and apparatus for performing display control of an electronic device, where the apparatus may comprise at least one portion (e.g. a portion or all) of the electronic device, such as a host processor, a display panel, etc. within the electronic device.

A multifunctional mobile phone may have various features when some applications are installed at the multifunctional mobile phone. An application (e.g. a game) running on the multifunctional mobile phone may be designed to draw image frames for being displayed on a screen of the multifunctional mobile phone. Some problems may occur, however. For example, when the application cannot draw the image frames in a stable manner, there may be latency differences regarding the image frames. In addition, when the speed of drawing the image frames is less than a refresh rate of the screen, the multifunctional mobile phone may suffer from abnormal display of the image frames. Thus, there is a need of a novel method and associated architecture to enhance the overall display performance of an electronic device.

SUMMARY

An objective of the present invention is to provide a method for performing display control of an electronic device, and to provide associated apparatus such as a host processor, a display panel, etc. within the electronic device, in order to solve the aforementioned problems.

Another objective of the present invention is to provide a method for performing display control of an electronic device, and to provide associated apparatus such as a host processor, a display panel, etc. within the electronic device, in order to enhance overall performance of the electronic device.

At least one embodiment of the present invention provides a method for performing display control of an electronic device, where the method may comprise: outputting an initial image, for displaying the initial image; checking whether a subsequent image is generated; in response to the subsequent image being not generated, checking whether a consecutively-skipped-image count is greater than or equal to a consecutively-skipped-image count threshold; and in response to the consecutively-skipped-image count being not greater than or equal to the consecutively-skipped-image count threshold, skipping a latest image, for preventing displaying the latest image, wherein the subsequent image is expected to be a next image of the latest image.

At least one embodiment of the present invention provides a host processor, where the host processor is applicable to display control of an electronic device, and the electronic device comprises the host processor and a display panel. The host processor may comprise a core circuit and comprise a bus interface that is coupled to the core circuit. The core circuit may be arranged to control the host processor, for controlling operations of the electronic device, wherein under control of the core circuit, the host processor performs the display control of the electronic device. In addition, the bus interface may be arranged to couple the display panel to the host processor. For example, the host processor outputs an initial image to the display panel, for displaying the initial image; the host processor checks whether a subsequent image is generated; in response to the subsequent image being not generated, the host processor checks whether a consecutively-skipped-image count is greater than or equal to a consecutively-skipped-image count threshold; and in response to the consecutively-skipped-image count being not greater than or equal to the consecutively-skipped-image count threshold, the host processor skips a latest image, for preventing displaying the latest image, wherein the subsequent image is expected to be a next image of the latest image. According to some embodiments, the apparatus may comprise the whole of the electronic device mentioned above.

At least one embodiment of the present invention provides a display panel, where the display panel is applicable to display control of an electronic device, and the electronic device comprises a host processor and the display panel. The display panel may comprise a bus interface, a display controller that is coupled to the bus interface, and a display module that is coupled to the display controller. The bus interface may be arranged to couple the display panel to the host processor, for receiving a plurality of images from the host processor. In addition, the display controller may be arranged to control operations of the display panel, wherein under control of the display controller, the display panel performs the display control of the electronic device. Additionally, the display module may be arranged to display the plurality of images. For example, the display controller outputs an initial image to the display module, for displaying the initial image, wherein the initial image is a first one of the plurality of images; the display controller checks whether a subsequent image is generated; in response to the subsequent image being not generated, the display controller checks whether a consecutively-skipped-image count is greater than or equal to a consecutively-skipped-image count threshold; and in response to the consecutively-skipped-image count being not greater than or equal to the consecutively-skipped-image count threshold, the display controller skips a latest image, for preventing displaying the latest image, wherein the subsequent image is expected to be a next image of the latest image. According to some embodiments, the apparatus may comprise the whole of the electronic device mentioned above.

The present invention method and the associated apparatus (e.g. the host processor, the display panel, etc. within the electronic device) can properly control operations of the electronic device, and more particularly, can perform dynamic refresh-rate adjustment through frame skipping, to guarantee the overall performance of the electronic device. In addition, implementing the embodiments of the present invention will not greatly increase additional costs, while solving problems of the related art. In comparison with conventional architectures, the present invention can achieve an optimal performance of the electronic device without introducing any side effect or in a way that is less likely to introduce side effects.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims, which refer to particular components. As one skilled in the art will appreciate, electronic equipment manufacturers may refer to a component by different names. This document does not intend to distinguish between components that differ in name but not in function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
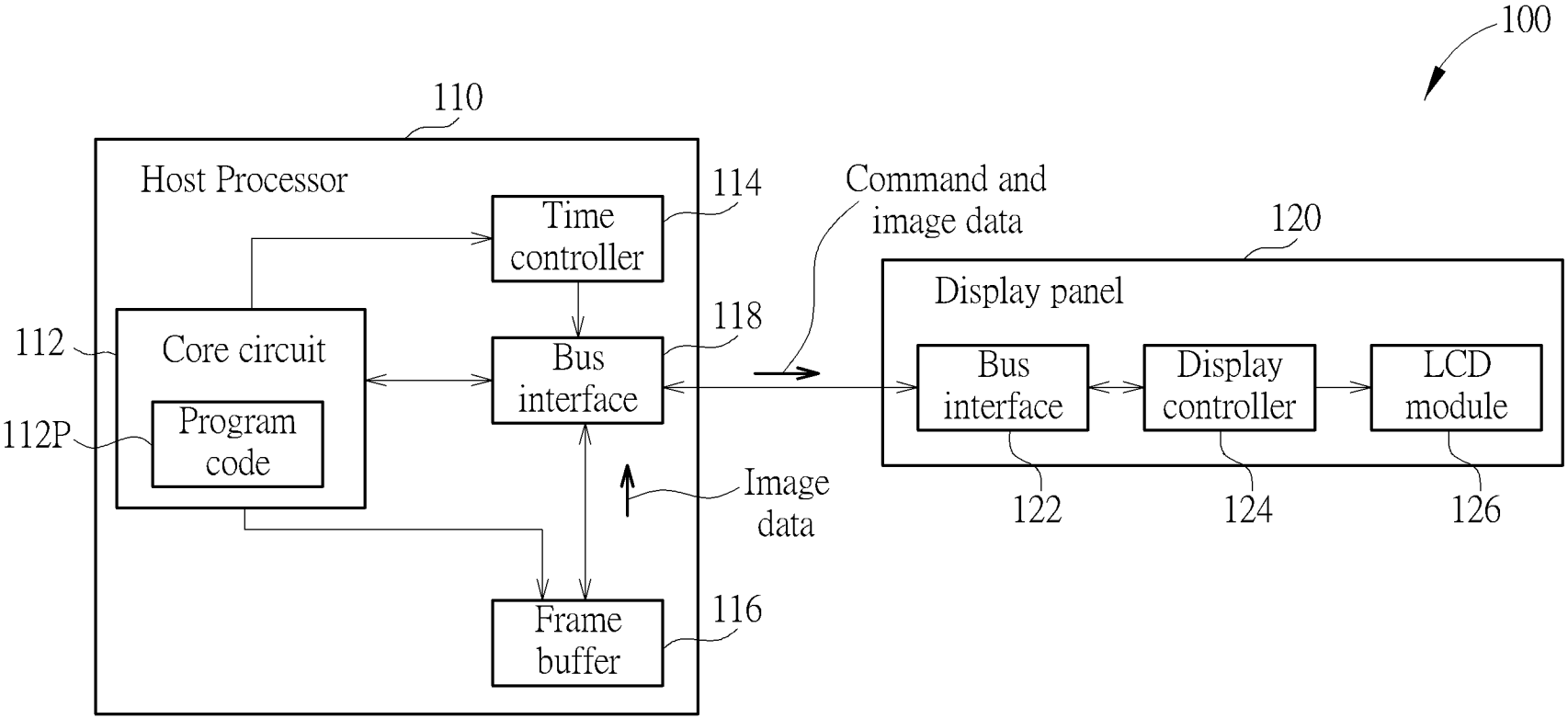
FIG. 1 is a diagram of an electronic device according to a first embodiment of the present invention.

FIG. 1 is a diagram of an electronic device 100 according to a first embodiment of the present invention. Examples of the electronic device may include, but are not limited to, a multifunctional mobile phone, a tablet computer, a wearable device, an all-in-one computer, and a laptop computer. As shown in FIG. 1, the electronic device 100 may comprise a host processor 110 and a display panel 120, where the host processor 110 may comprise a core circuit 112, a time controller 114, a frame buffer 116, and a bus interface 118, and the display panel 120 may comprise a bus interface 122, a display controller 124, and a display module such as a liquid crystal display (LCD) module 126, but the present invention is not limited thereto. For example, the display module such as the LCD module 126 and a touch-sensitive module (not shown) may be integrated into the same module to form a touch-sensitive display device (e.g. a touch screen), and the touch-sensitive display device may comprise a touch controller for performing touch control to detect user inputs via the touch-sensitive module. The bus interfaces 118 and 122 may be implemented with interface circuits complying with a specific specification. For example, the specific specification may be the Mobile Industry Processor Interface (MIPI) Display Serial Interface (DSI) specification of the MIPI Alliance, and the bus interfaces 118 and 122 may be implemented to be DSI interface circuits. In addition, the electronic device 100 may further comprise additional circuits such as a power management circuit, a wireless communications circuit, a storage interface circuit, etc. (not shown) to provide the electronic device 100 to perform associated operations such as power management, wireless communications, storage interfacing, etc. Additionally, the host processor 110 may control various operations of the electronic device 100. For example, some program codes 112P running on the host processor 110 (e.g. the core circuit 112) may control the electronic device 100, to make the electronic device 100 be equipped with various functions. Examples of the program codes 112P may include, but are not limited to, an operating system (OS), one or more drivers, and one or more applications.

According to this embodiment, the host processor 110 is applicable to display control of the electronic device 100. More particularly, the core circuit 112 may be arranged to control the host processor 110, for controlling the operations of the electronic device 100. Under the control of the core circuit 112, the host processor 110 may perform the display control of the electronic device 100. For example, the host processor 110 (e.g. the core circuit 112) may set a refresh rate of the time controller 114 to be a target refresh rate in advance, for controlling the host processor 110 to output images to the display panel 120 according to the target refresh rate by default, and may dynamically perform refresh-rate adjustment when there is a need, where the time controller 114 may be arranged to control the timing of outputting image data of the images from the frame buffer 116 to the display panel 120, but the present invention is not limited thereto. In addition, the bus interfaces 118 and 122 may be arranged to couple the display panel 120 to the host processor 110, and transmit one or more commands and the image data from the host processor 110 to the display panel 120.

Figure 2:
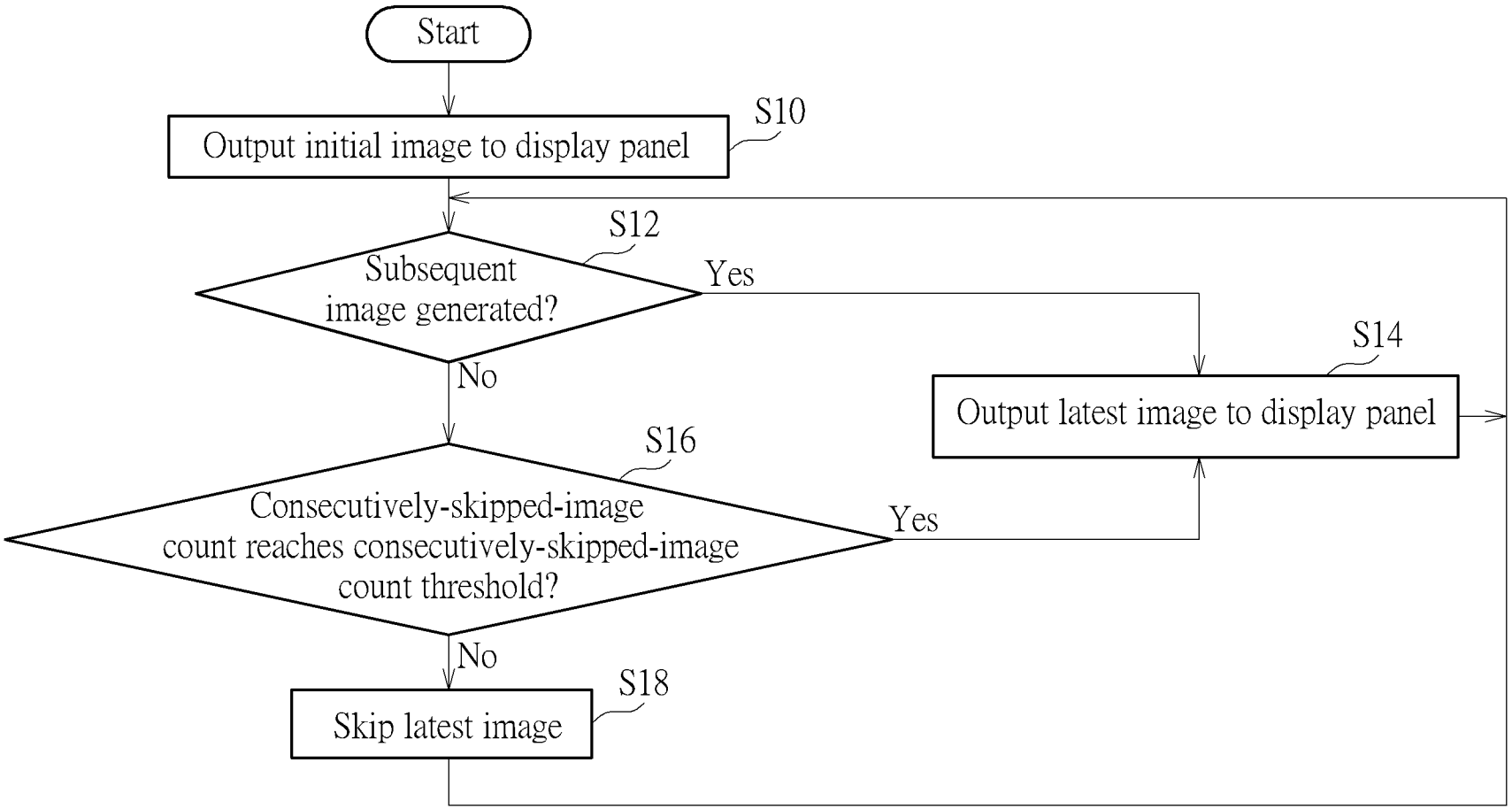
FIG. 2 is a working flow of a method for performing display control of an electronic device according to an embodiment of the present invention.

FIG. 2 is a working flow of a method for performing display control of an electronic device according to an embodiment of the present invention. The method may be applied to the electronic device 100 shown in FIG. 1, and more particularly, may be applied to the host processor 110 (e.g. the core circuit 112 running the program codes 112P, the time controller 114, the frame buffer 116, and the bus interface 118 shown in FIG. 1) and the display panel 120. According to this embodiment, under control of a target application (e.g. a game) running on the host processor 110 (e.g. the core circuit 112), the electronic device 100 may generate (e.g. draw) a plurality of images comprising a first image, a second image, etc. and store the plurality of images into the frame buffer 116, for example, one by one, and may obtain the plurality of images from the frame buffer 116 and transmit the plurality of images to the display panel 120, for displaying the plurality of images with the display module such as the LCD module 126, but the present invention is not limited thereto.

In Step S10, the host processor 110 may output an initial image (e.g. the first image of the plurality of images) to the display panel 120, for displaying the initial image, where the initial image may be displayed by the display panel 120 (e.g. the display module such as the LCD module 126). For example, the target application (e.g. the game) running on the core circuit 112 may generate an image as the initial image, and the host processor 110 may output this image to the display panel 120, in order to display this image, but the present invention is not limited thereto. According to some embodiments, the target application (e.g. the game) running on the core circuit 112 may generate an image as the initial image with aid of a graphics processing unit (GPU) within the electronic device 100, and the host processor 110 may output this image to the display panel 120, in order to display this image.

In Step S12, the host processor 110 may check whether a subsequent image is generated. If yes (e.g. the subsequent image is generated), Step S14 is entered; if no (e.g. the subsequent image is not generated), Step S16 is entered. For example, the target application (e.g. the game) running on the core circuit 112 may generate another image as the subsequent image, and the host processor 110 may output this image to the display panel 120, in order to display this image, but the present invention is not limited thereto. According to some embodiments, the target application (e.g. the game) running on the core circuit 112 may generate another image as the subsequent image with aid of the GPU within the electronic device 100, and the host processor 110 may output this image to the display panel 120, in order to display this image.

In Step S14, the host processor 110 may output the latest image to the display panel 120, for displaying the latest image, where the latest image may be displayed by the display panel 120 (e.g. the display module such as the LCD module 126). After Step S14 is executed, Step S12 is entered, in order to wait for the next image.

In Step S16, the host processor 110 may check whether a consecutively-skipped-image count (e.g. the number of consecutively skipped images) reaches (e.g. greater than or equal to) a consecutively-skipped-image count threshold (e.g. the maximum allowable consecutively-skipped-image count). If yes (e.g. the consecutively-skipped-image count is greater than or equal to the consecutively-skipped-image count threshold), Step S14 is entered; if no (e.g. the consecutively-skipped-image count is less than the consecutively-skipped-image count threshold), Step S18 is entered. Please note that the host processor 110 may set the consecutively-skipped-image count threshold to be a predetermined value in advance, in order to correctly perform the checking operation of Step S16. For example, the consecutively-skipped-image count threshold may be a positive integer.

In Step S18, the host processor 110 may skip the latest image, for preventing displaying the latest image. As the checking result of Step S12 is "No" (which means the next image has not been generated) while Steps S16 and S18 are subsequently entered, the latest image mentioned in Step S18 may represent a previously generated image, where at this moment, the subsequent image is expected to be the next image of the latest image. After Step S18 is executed, Step S12 is entered, in order to wait for the next image.

For example, regarding executing Step S12 for the first time, if the checking result of Step S12 is "Yes" (which means the subsequent image has been generated), Step S14 is entered at this moment, and the latest image mentioned in Step S14 may represent the subsequent image that has just been generated (e.g. the second image that comes after the initial image); otherwise (e.g. the checking result of Step S12 is "No"), Step S16 is entered at this moment. Afterward, when the checking result of Step S16 is "Yes", Step S14 is entered at this moment, and the latest image mentioned in Step S14 may represent the initial image. For another example, regarding executing Step S12 for another time, if the checking result of Step S12 is "Yes" (which means the subsequent image has been generated), Step S14 is entered at this moment, and the latest image mentioned in Step S14 may represent the subsequent image that has just been generated (e.g. the last image of multiple images that have been generated); otherwise (e.g. the checking result of Step S12 is "No"), Step S16 is entered at this moment. Afterward, if the checking result of Step S16 is "No", Step S18 is entered at this moment, and the latest image mentioned in Step S18 represent the previously generated image; otherwise (e.g. the checking result of Step S16 is "Yes"), Step S14 is entered at this moment, and the latest image mentioned in Step S14 may represent the previously generated image (e.g. the latest one of a plurality of subsequent images coming after the initial image).

For better comprehension, the method may be illustrated with the working flow shown in FIG. 2, but the present invention is not limited thereto. According to some embodiments, one or more steps may be added, deleted, or changed in the working flow shown in FIG. 2.

Some implementation details regarding Steps S16 and S18 may be described as follows. As most of the steps in the working flow shown in FIG. 2 (e.g. Steps S12, S14, S16, and S18) may be executed multiple times, respectively, the host processor 110 may count the number of images that have been consecutively skipped in Step S18 to be the consecutively-skipped-image count (e.g. the number of consecutively skipped images) mentioned in Step S16. According to some embodiments, the host processor 110 may set the consecutively-skipped-image count threshold (e.g. the maximum allowable consecutively-skipped-image count) according to the speed of generating (e.g. drawing) the images and the minimum refresh rate that the display panel 120 can support. For better comprehension, assume that the target application (e.g. the game) running on the host processor 110 may generate the images at an average speed of 60 Hertz (Hz). For example, when the minimum refresh rate that the display panel 120 can support is equal to 30 Hz, the host processor 110 may set the consecutively-skipped-image count threshold to be 1 (e.g. (60 Hz/30 Hz)−1=2−1=1), where the host processor 110 may skip up to one image for every two images; when the minimum refresh rate that the display panel 120 can support is equal to 20 Hz, the host processor 110 may set the consecutively-skipped-image count threshold to be 2 (e.g. (60 Hz/20 Hz)−1=3−1=2), where the host processor 110 may skip up to two images for every three images; when the minimum refresh rate that the display panel 120 can support is equal to 15 Hz, the host processor 110 may set the consecutively-skipped-image count threshold to be 3 (e.g. (60 Hz/15 Hz)−1=4−1=3), where the host processor 110 may skip up to three images for every four images; and the rest may be deduced by analogy. For brevity, similar descriptions for these embodiments are not repeated in detail here.

According to some embodiments, under control of the target application (e.g. the game) running on the host processor 110 (e.g. the core circuit 112), the electronic device 100 may generate (e.g. draw) the plurality of images comprising the first image, the second image, etc., store the plurality of images into an external buffer of the host processor 110 (e.g. a Dynamic Random Access Memory (DRAM) within the electronic device 100) one by one, and transmit the plurality of images from the external buffer to the display panel 120, for displaying the plurality of images with the display module such as the LCD module 126. For brevity, similar descriptions for these embodiments are not repeated in detail here.

Figure 3:
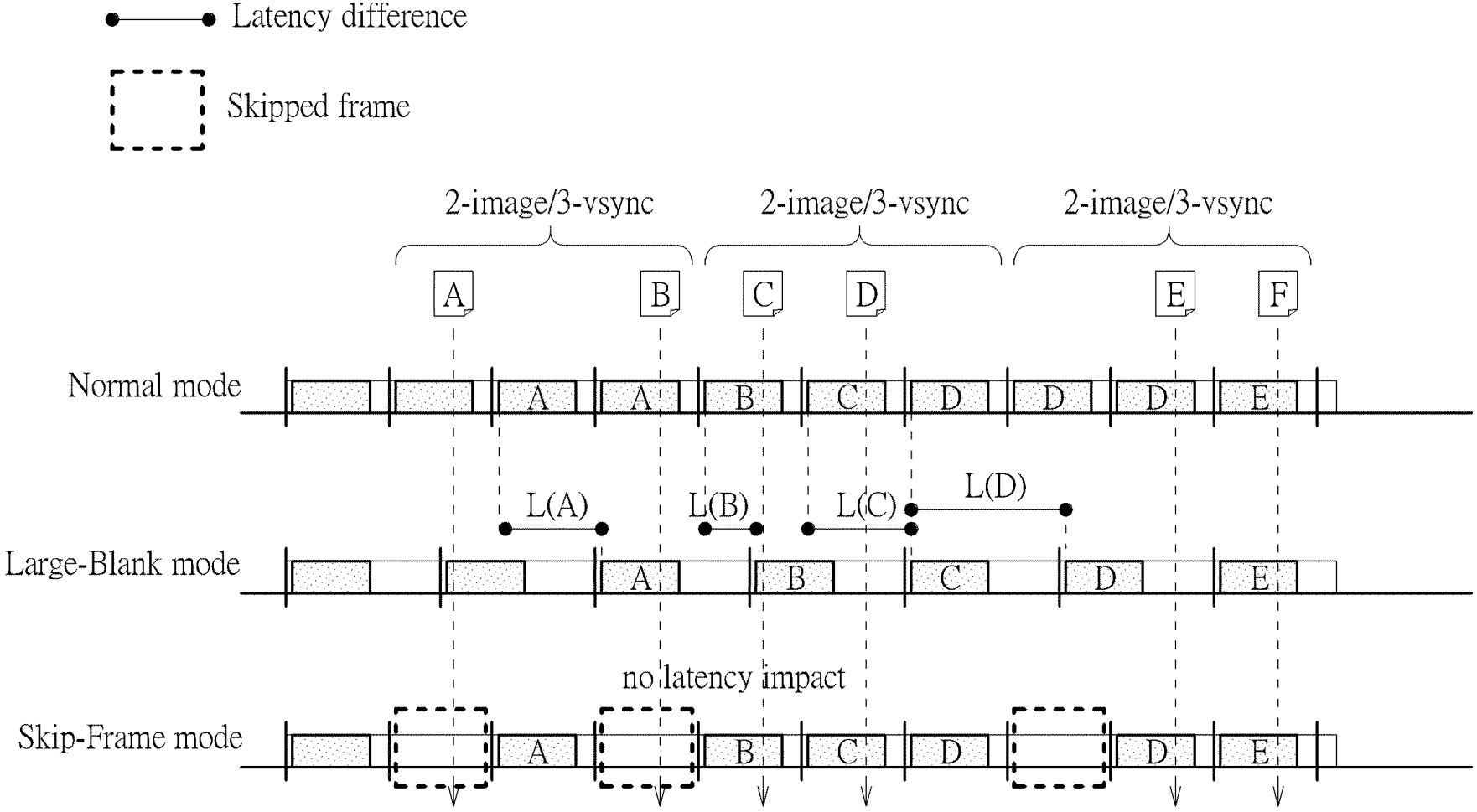
FIG. 3 illustrates some implementation details of the method shown in FIG. 2 according to an embodiment of the present invention.

FIG. 3 illustrates some implementation details of the method shown in FIG. 2 according to an embodiment of the present invention. A series of image frames such as the images A, B, C, D, E, F, etc. shown in the uppermost of FIG. 3 may be taken as an example of the plurality of images comprising the first image, the second image, etc., but the present invention is not limited thereto. According to this embodiment, under control of at least one portion (e.g. a portion or all) of the program codes 112P running on the host processor 110 (e.g. the core circuit 112), the electronic device 100 may operate in one of a plurality of predetermined modes (e.g. a Normal mode, a Large-Blank mode, a Skip-Frame mode, etc.), to display the series of image frames, and more particularly, may dynamically switch between the plurality of predetermined modes when there is a need, for example, for dealing with various behaviors of the target application (e.g. the game) and/or various conditions of the electronic device 100, where the Skip-Frame mode may be associated with the method shown in FIG. 2.

For better comprehension, different display results respectively corresponding to the Normal mode, the Large-Blank mode, and the Skip-Frame mode may be illustrated as shown in FIG. 3 to indicate that the method shown in FIG. 2 can indeed enhance the overall performance of the electronic device 100. Assume that the average speed of generating or updating (e.g. drawing) the series of image frames such as the images A, B, C, D, E, F, etc. is equal to 40 frames per second (FPS), and the display panel 120 may support the refresh rate of 40 FPS. In this embodiment, the actual speed of generating or updating the series of image frames may be unstable, and may correspond to two images per three vertical synchronization (V-sync) pulses (labeled "2-image/3-vsync" in FIG. 3, for brevity). For example, when the electronic device 100 operates in the Normal mode, the display panel 120 may display a sequence of images such as {A, A, B, C, D, D, D, E, . . . } with a constant latency. When the electronic device 100 operates in the Large-Blank mode, the display panel 120 may display another sequence of images such as {A, B, C, D, E, . . . }, but some varying latency differences such as L(A), L(B), L(C), and L(D) may be introduced, which means these images may be displayed in a non-smooth manner. When the electronic device 100 operates in the Skip-Frame mode, the display panel 120 may display yet another sequence of images such as {A, B, C, D, D, E, . . . } at correct timing, respectively. As shown in FIG. 3, the electronic device 100 (e.g. the host processor 110) may skip some image frames (e.g. the skipped frames, such as the images that are skipped in Step S18) according to the method as shown in FIG. 3, to guarantee the correct timing for displaying the images. As a result, there is no latency impact in the Skip-Frame mode.

Figure 4:
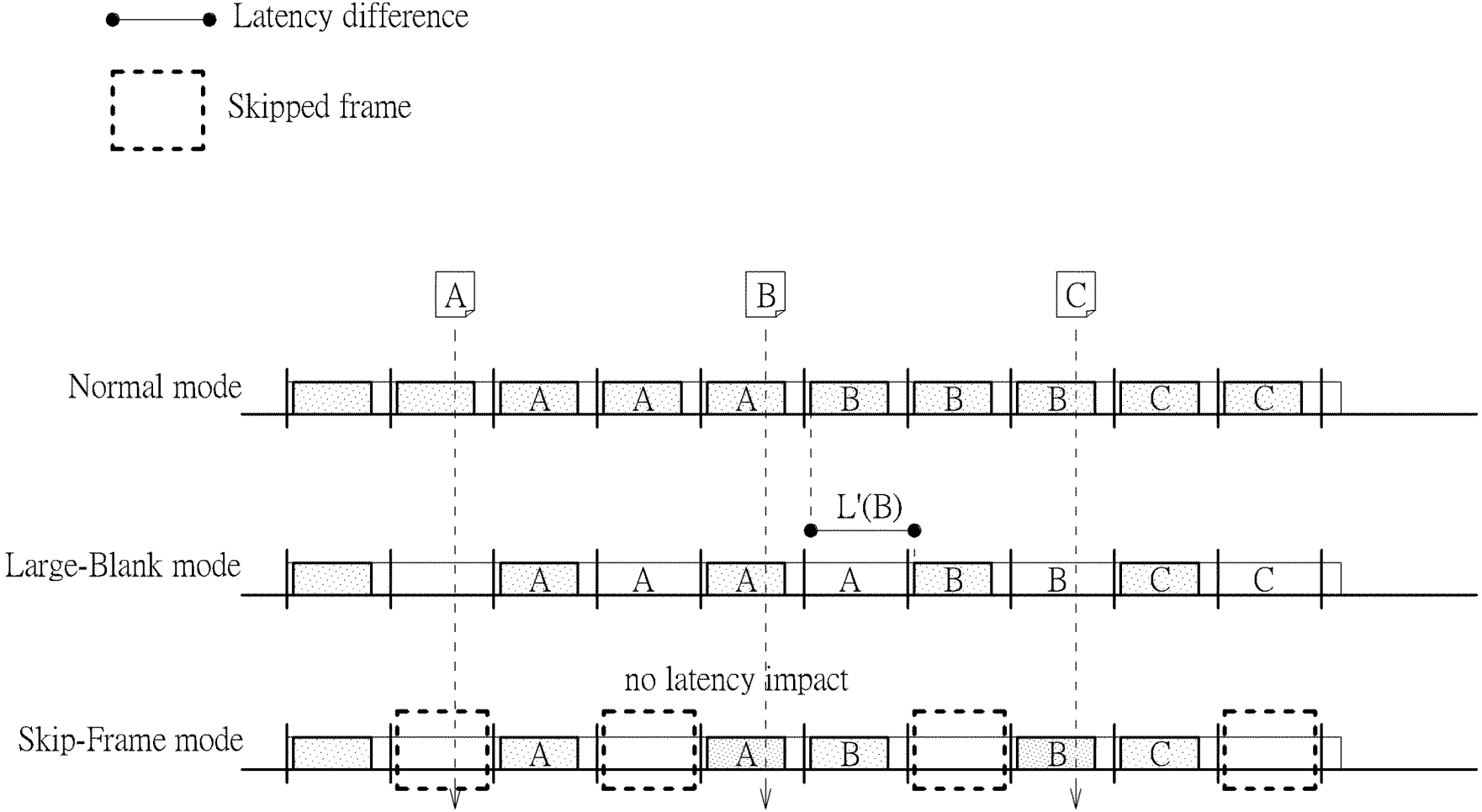
FIG. 4 illustrates some implementation details of the method shown in FIG. 2 according to another embodiment of the present invention.

FIG. 4 illustrates some implementation details of the method shown in FIG. 2 according to another embodiment of the present invention. A series of image frames such as the images A, B, C, etc. shown in the uppermost of FIG. 4 may be taken as an example of the plurality of images comprising the first image, the second image, etc., but the present invention is not limited thereto. According to this embodiment, under control of at least one portion (e.g. a portion or all) of the program codes 112P running on the host processor 110 (e.g. the core circuit 112), the electronic device 100 may operate in one of the plurality of predetermined modes (e.g. the Normal mode, the Large-Blank mode, the Skip-Frame mode, etc.), to display the series of image frames, and more particularly, may dynamically switch between the plurality of predetermined modes when there is a need, for example, for dealing with various behaviors of the target application (e.g. the game) and/or various conditions of the electronic device 100.

For better comprehension, different display results respectively corresponding to the Normal mode, the Large-Blank mode, and the Skip-Frame mode may be illustrated as shown in FIG. 4 to indicate that the method shown in FIG. 2 can indeed enhance the overall performance of the electronic device 100. Assume that the average speed of generating or updating (e.g. drawing) the series of image frames such as the images A, B, C, etc. is equal to 20 FPS, and the minimum refresh rate that the display panel 120 can support may be 30 FPS. In this embodiment, the display panel 120 cannot support a lower refresh rate such as 20 FPS. For example, when the electronic device 100 operates in the Normal mode, the display panel 120 may display a sequence of images such as {A, A, A, B, B, B, C, C, . . . } with a constant latency, where unnecessary processing (e.g. image transmission) and the associated power consumption may be introduced. When the electronic device 100 operates in the Large-Blank mode, the display panel 120 may display another sequence of images such as {A, A, B, C, . . . } (illustrated with {(A, A), (A, A), (B, B), (C, C), . . . } in FIG. 4, for better comprehension), but at least one latency difference such as L'(B) may be introduced, which means these images may be displayed in a non-smooth manner. When the electronic device 100 operates in the Skip-Frame mode, the display panel 120 may display yet another sequence of images such as {A, A, B, B, C, . . . } at correct timing, respectively. As shown in FIG. 4, the electronic device 100 (e.g. the host processor 110) may skip some image frames (e.g. the skipped frames, such as the images that are skipped in Step S18) according to the method as shown in FIG. 3, to guarantee the correct timing for displaying the images. As a result, there is no latency impact in the Skip-Frame mode.

Figure 5:
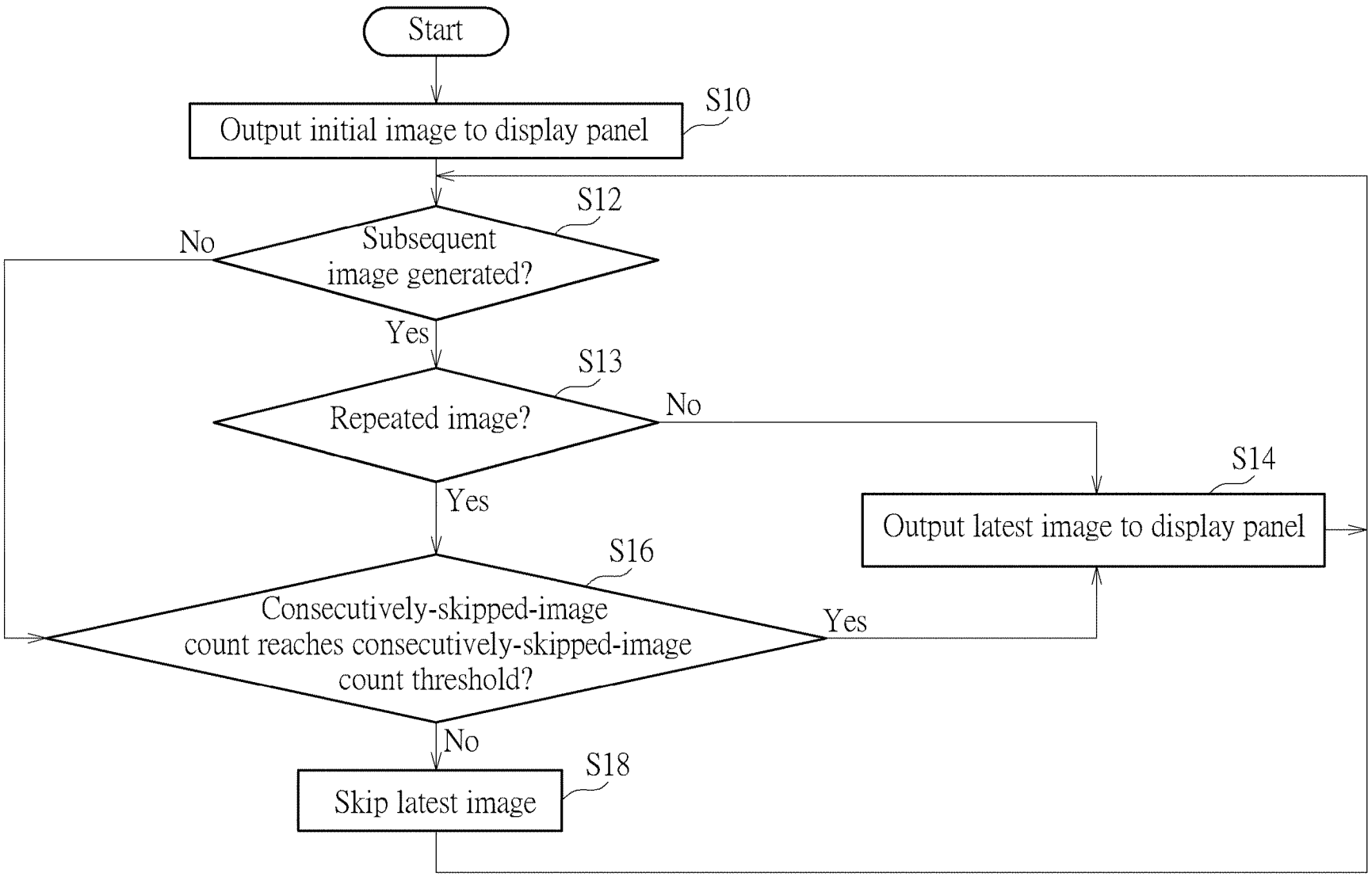
FIG. 5 is a working flow of the method for performing display control of the electronic device according to another embodiment of the present invention.

FIG. 5 is a working flow of the method for performing display control of the electronic device according to another embodiment of the present invention. In comparison with the working flow shown in FIG. 2, Step S13 may be added in this embodiment, and more particularly, may be inserted between Steps S12, S14, and S16 as shown in FIG. 5.

In Step S13, the host processor 110 may check whether the latest image is a repeated image (e.g. the latest image of two consecutively generated images is equal to the previous image of the latest image, such as the other image within the two consecutively generated images). If yes (e.g. the latest image is equal to the previous image thereof), Step S16 is entered; if no (e.g. the latest image is not equal to the previous image thereof), Step S14 is entered. As the checking result of Step S12 is "Yes" (which means the subsequent image is generated) while Step S13 is entered, the latest image mentioned in Step S13 may represent the subsequent image that is just generated in Step S12. For brevity, similar descriptions for this embodiment are not repeated in detail here.

For better comprehension, the method may be illustrated with the working flow shown in FIG. 5, but the present invention is not limited thereto. According to some embodiments, one or more steps may be added, deleted, or changed in the working flow shown in FIG. 5.

According to some embodiments, in the Skip-Frame mode shown in FIG. 3, the electronic device 100 (e.g. the host processor 110) may skip some image frames (e.g. the skipped frames, such as the images that are skipped in Step S18) according to the method as shown in FIG. 5, to guarantee the correct timing for displaying the images. As a result, there is no latency impact in the Skip-Frame mode. For brevity, similar descriptions for these embodiments are not repeated in detail here.

According to some embodiments, in the Skip-Frame mode shown in FIG. 4, the electronic device 100 (e.g. the host processor 110) may skip some image frames (e.g. the skipped frames, such as the images that are skipped in Step S18) according to the method as shown in FIG. 5, to guarantee the correct timing for displaying the images. As a result, there is no latency impact in the Skip-Frame mode. For brevity, similar descriptions for these embodiments are not repeated in detail here.

Figure 6:
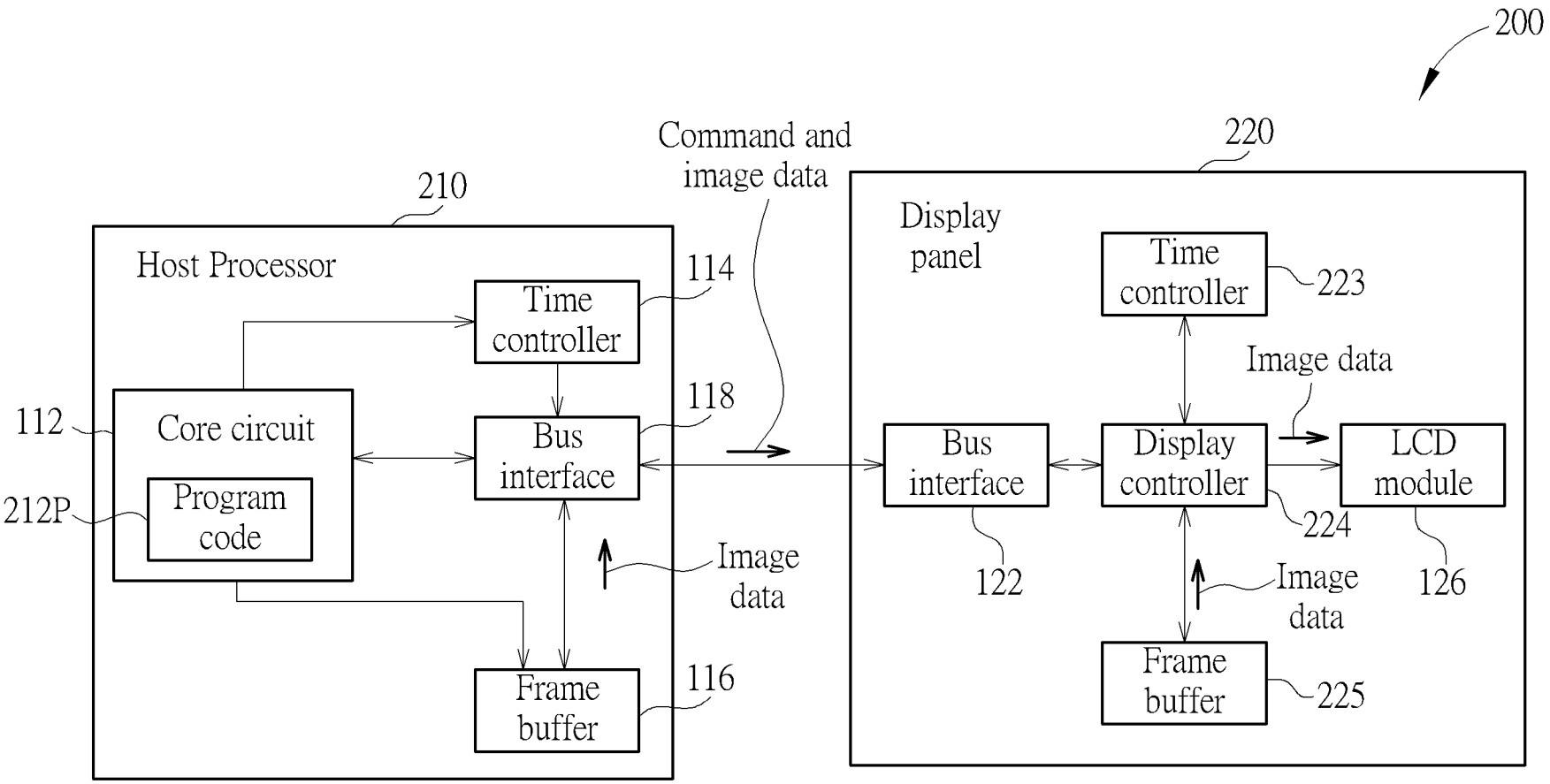
FIG. 6 is a diagram of an electronic device according to another embodiment of the present invention.

FIG. 6 is a diagram of an electronic device 200 according to another embodiment of the present invention. In comparison with the architecture shown in FIG. 1, the display controller 124 mentioned above may be replaced with one or more other circuits such as a time controller 223, a display controller 224, and a frame buffer 225 to operate according to the present invention method as shown in any of FIG. 2 and FIG. 5, and the program codes 112P may be changed correspondingly, and therefore may be renamed as the program codes 212P in this embodiment. In response to the change in the architecture, the associated numerals may be changed to indicate that the host processor 110 and the display panel 120 shown in FIG. 1 may be replaced with the host processor 210 and the display panel 220 in this embodiment, respectively. For example, the display module such as the LCD module 126 and the touch-sensitive module mentioned above may be integrated into the same module to form the touch-sensitive display device (e.g. the touch screen).

According to this embodiment, the display panel 220 is applicable to display control of the electronic device 200. More particularly, the core circuit 112 may be arranged to control the host processor 210, for controlling the operations of the electronic device 200. Under the control of the core circuit 112, the host processor 210 may perform preliminary display control of the electronic device 200. For example, the host processor 210 (e.g. the core circuit 112) may set the refresh rate of the time controller 114 to be the target refresh rate in advance, for controlling the host processor 210 to output images to the display panel 220 according to the target refresh rate by default, and may dynamically perform refresh-rate adjustment when there is a need, where the time controller 114 may be arranged to control the timing of outputting image data of the images from the frame buffer 116 to the display panel 120, but the present invention is not limited thereto. In addition, the bus interfaces 118 and 122 may be arranged to couple the display panel 220 to the host processor 210, and transmit one or more commands and the image data from the host processor 210 to the display panel 220. The bus interface 122 may receive the plurality of images comprising the first image, the second image, etc. from the host processor 210 for the display controller 224, to allow the plurality of images to be temporarily stored into the frame buffer 225, for example, one by one, where the display controller 224 or the bus interface 122 may temporarily store the plurality of images into the frame buffer 225, but the present invention is not limited thereto. Additionally, the display controller 224 may control the operations of the display panel 220. Under the control of the display controller 224, the display panel 220 may perform the display control of the electronic device 200, to obtain the plurality of images from the frame buffer 225 and transmit the plurality of images to the display module such as the LCD module 126. As a result, the display module such as the LCD module 126 may display the plurality of images.

Some implementation details regarding the display control performed by the display panel 220 may be described as follows. The method may be applied to the electronic device 200 shown in FIG. 6, and more particularly, may be applied to the host processor 210 and the display panel 220 (e.g. the bus interface 122, the time controller 223, the display controller 224, the frame buffer 225, and the display module 126 shown in FIG. 6). Taking the working flow shown in FIG. 2 as an example, in Step S10, the display controller 224 may output the initial image (e.g. the first image of the plurality of images) to the display module such as the LCD module 126, for displaying the initial image, where the initial image is the first one of the plurality of images. In Step S12, the display controller 224 may check whether the subsequent image is generated. If yes (e.g. the subsequent image is generated), Step S14 is entered; if no (e.g. the subsequent image is not generated), Step S16 is entered. In Step S14, the display controller 224 may output the latest image to the display module such as the LCD module 126, for displaying the latest image. After Step S14 is executed, Step S12 is entered, in order to wait for the next image. In Step S16, the display controller 224 may check whether the consecutively-skipped-image count (e.g. the number of consecutively skipped images) reaches (e.g. greater than or equal to) the consecutively-skipped-image count threshold (e.g. the maximum allowable consecutively-skipped-image count). If yes (e.g. the consecutively-skipped-image count is greater than or equal to the consecutively-skipped-image count threshold), Step S14 is entered; if no (e.g. the consecutively-skipped-image count is less than the consecutively-skipped-image count threshold), Step S18 is entered. In Step S18, the display controller 224 may skip the latest image, for preventing displaying the latest image. For brevity, similar descriptions for this embodiment are not repeated in detail here.

In the embodiment shown in FIG. 6, the display control performed by the display panel 220 may be described according to the working flow shown in FIG. 2, but the present invention is not limited thereto. According to another embodiment, the display control performed by the display panel 220 may be described according to the working flow shown in FIG. 5. As mentioned above, Step S13 may be added in this embodiment, and more particularly, may be inserted between Steps S12, S14, and S16 as shown in FIG. 5. In Step S13, the display controller 224 may check whether the latest image is a repeated image (e.g. the latest image of the two consecutively generated images is equal to the previous image of the latest image, such as the other image within the two consecutively generated images). If yes (e.g. the latest image is equal to the previous image thereof), Step S16 is entered; if no (e.g. the latest image is not equal to the previous image thereof), Step S14 is entered. For brevity, similar descriptions for this embodiment are not repeated in detail here.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for performing display control of an electronic device, the method comprising:

outputting an initial image, for displaying the initial image;

checking whether a subsequent image is generated;

in response to the subsequent image being not generated, checking whether a consecutively-skipped-image count is greater than or equal to a consecutively-skipped-image count threshold; and in response to the consecutively-skipped-image count being not greater than or equal to the consecutively-skipped-image count threshold, skipping a latest image, for preventing displaying the latest image, wherein the subsequent image is expected to be a next image of the latest image;

wherein the step of checking whether the subsequent image is generated is executed multiple times to respectively trigger executing the step of checking whether the consecutively-skipped-image count is greater than or equal to the consecutively-skipped-image count threshold; the step of checking whether the consecutively-skipped-image count is greater than or equal to the consecutively-skipped-image count threshold is executed multiple times to respectively trigger executing the step of skipping the latest image; and the method further comprises:

in response to the consecutively-skipped-image count being greater than or equal to the consecutively-skipped-image count threshold, outputting another image, for displaying the other image, wherein the other image is a latest one of a plurality of subsequent images coming after the initial image.

2. The method of claim 1, wherein the consecutively-skipped-image count represents a number of consecutively skipped images, and the consecutively-skipped-image count threshold represents a maximum allowable consecutively-skipped-image count.

3. The method of claim 1, wherein after the step of outputting the other image is executed, the step of checking whether the subsequent image is generated is executed.

4. The method of claim 1, wherein after the step of skipping the latest image is executed, the step of checking whether the subsequent image is generated is executed.

5. The method of claim 1, further comprising:

in response to the subsequent image being generated, outputting the subsequent image, for displaying the subsequent image.

6. The method of claim 1, further comprising:

in response to the subsequent image being generated, checking whether the subsequent image is a repeated image; and in response to the subsequent image being not the repeated image, outputting the subsequent image, for displaying the subsequent image.

7. The method of claim 6, wherein the step of checking whether the subsequent image is the repeated image is executed multiple times to respectively trigger executing the step of outputting the subsequent image; and in response to the subsequent image being the repeated image, the step of checking whether the consecutively-skipped-image count is greater than or equal to the consecutively-skipped-image count threshold is executed.

8. The method of claim 1, wherein a host processor of the electronic device is arranged to perform the display control according to the method, and the electronic device comprises the host processor and a display panel; and outputting the initial image further comprises:

obtaining the initial image from a frame buffer within the electronic device to output the initial image to the display panel, wherein the frame buffer is positioned outside the display panel.

9. The method of claim 1, wherein a display panel of the electronic device is arranged to perform the display control according to the method, and the electronic device comprises the display panel; and outputting the initial image further comprises:

obtaining the initial image from a frame buffer of the display panel to output the initial image to a display module of the display panel, wherein the display panel comprises the frame buffer and the display module.

10. A host processor, applicable to display control of an electronic device, the electronic device comprising the host processor and a display panel, the host processor comprising:

a core circuit, arranged to control the host processor, for controlling operations of the electronic device, wherein under control of the core circuit, the host processor performs the display control of the electronic device; and a bus interface, coupled to the core circuit, arranged to couple the display panel to the host processor;

wherein:

the host processor outputs an initial image to the display panel, for displaying the initial image;

the host processor checks whether a subsequent image is generated;

in response to the subsequent image being not generated, the host processor checks whether a consecutively-skipped-image count is greater than or equal to a consecutively-skipped-image count threshold; and in response to the consecutively-skipped-image count being not greater than or equal to the consecutively-skipped-image count threshold, the host processor skips a latest image, for preventing displaying the latest image, wherein the subsequent image is expected to be a next image of the latest image;

wherein the operation of checking whether the subsequent image is generated is executed multiple times to respectively trigger executing the operation of checking whether the consecutively-skipped-image count is greater than or equal to the consecutively-skipped-image count threshold; the operation of checking whether the consecutively-skipped-image count is greater than or equal to the consecutively-skipped-image count threshold is executed multiple times to respectively trigger executing the operation of skipping the latest image; and in response to the consecutively-skipped-image count being greater than or equal to the consecutively-skipped-image count threshold, the host processor outputs another image to the display panel, for displaying the other image, wherein the other image is a latest one of a plurality of subsequent images coming after the initial image.

11. The host processor of claim 10, wherein the consecutively-skipped-image count represents a number of consecutively skipped images, and the consecutively-skipped-image count threshold represents a maximum allowable consecutively-skipped-image count.

12. The host processor of claim 10, wherein in response to the subsequent image being generated, the host processor outputs the subsequent image to the display panel, for displaying the subsequent image.

13. The host processor of claim 10, wherein in response to the subsequent image being generated, the host processor checks whether the subsequent image is a repeated image; and in response to the subsequent image being not the repeated image, the host processor outputs the subsequent image to the display panel, for displaying the subsequent image.

14. A display panel, applicable to display control of an electronic device, the electronic device comprising a host processor and the display panel, the display panel comprising:

a bus interface, arranged to couple the display panel to the host processor, for receiving a plurality of images from the host processor;

a display controller, coupled to the bus interface, arranged to control operations of the display panel, wherein under control of the display controller, the display panel performs the display control of the electronic device; and a display module, coupled to the display controller, arranged to display the plurality of images;

wherein:

the display controller outputs an initial image to the display module, for displaying the initial image, wherein the initial image is a first one of the plurality of images;

the display controller checks whether a subsequent image is generated;

in response to the subsequent image being not generated, the display controller checks whether a consecutively-skipped-image count is greater than or equal to a consecutively-skipped-image count threshold; and in response to the consecutively-skipped-image count being not greater than or equal to the consecutively-skipped-image count threshold, the display controller skips a latest image, for preventing displaying the latest image, wherein the subsequent image is expected to be a next image of the latest image;

wherein the operation of checking whether the subsequent image is generated is executed multiple times to respectively trigger executing the operation of checking whether the consecutively-skipped-image count is greater than or equal to the consecutively-skipped-image count threshold; the operation of checking whether the consecutively-skipped-image count is greater than or equal to the consecutively-skipped-image count threshold is executed multiple times to respectively trigger executing the operation of skipping the latest image; and in response to the consecutively-skipped-image count being greater than or equal to the consecutively-skipped-image count threshold, the display controller outputs another image to the display panel, for displaying the other image, wherein the other image is a latest one of a plurality of subsequent images coming after the initial image.

15. The display panel of claim 14, wherein the consecutively-skipped-image count represents a number of consecutively skipped images, and the consecutively-skipped-image count threshold represents a maximum allowable consecutively-skipped-image count.

16. The display panel of claim 14, wherein in response to the subsequent image being generated, the display controller outputs the subsequent image to the display module, for displaying the subsequent image.

17. The display panel of claim 14, wherein in response to the subsequent image being generated, the display controller checks whether the subsequent image is a repeated image; and in response to the subsequent image being not the repeated image, the display controller outputs the subsequent image to the display module, for displaying the subsequent image.

* * * * *